US006487995B2

(12) United States Patent
Markyvech et al.

(10) Patent No.: US 6,487,995 B2
(45) Date of Patent: Dec. 3, 2002

(54) ENGINE CONTROLLER AND ENCLOSURE ASSEMBLY

(75) Inventors: Craig R. Markyvech, Romulus, MI (US); Dennis J. Sitek, Grosse Ile, MI (US); Jeffery S. Hawkins, Farmington Hills, MI (US)

(73) Assignee: Detroit Diesel Corporation, Detroit, MI (US)

( * ) Notice: Subject to any disclaimer, the term of this patent is extended or adjusted under 35 U.S.C. 154(b) by 49 days.

(21) Appl. No.: 09/726,734

(22) Filed: Nov. 30, 2000

(65) Prior Publication Data

US 2002/0062812 A1 May 30, 2002

(51) Int. Cl.[7] ..... F01P 1/06; F02P 7/08

(52) U.S. Cl. ..... 123/41.31; 123/647; 123/195 E

(58) Field of Search ..... 123/195 E, 198 E, 123/5, 184.24, 478, 41.31, 647; 307/9.1, 10.1; 361/733, 725, 726, 730, 250, 752, 796, 803; 174/35, 17.05

(56) References Cited

U.S. PATENT DOCUMENTS

| | | | | | |
|---|---|---|---|---|---|
| 3,740,692 | A | * | 6/1973 | Filhaber | 339/19 |
| 4,143,895 | A | | 3/1979 | Kirchweger et al. | |
| 4,409,641 | A | * | 10/1983 | Jakob et al. | 361/386 |
| 4,546,408 | A | * | 10/1985 | Rodseth et al. | 361/386 |
| 4,561,396 | A | * | 12/1985 | Sakamoto et al. | 123/647 |
| 4,893,590 | A | * | 1/1990 | Kashimura et al. | 123/41.31 |
| 5,075,822 | A | * | 12/1991 | Baumler et al. | 123/41.31 |
| 5,207,186 | A | * | 5/1993 | Okita | 123/41.31 |
| 5,215,157 | A | | 6/1993 | Teich | |
| D367,430 | S | | 2/1996 | Greenberg et al. | |
| 5,610,493 | A | | 3/1997 | Wieloch | |
| 5,685,617 | A | * | 11/1997 | Hio et al. | 303/113.1 |
| 5,694,895 | A | * | 12/1997 | Tsunoda et al. | 123/41.31 |
| 5,927,240 | A | | 7/1999 | Maxon | |
| D412,897 | S | | 8/1999 | Attwood et al. | |
| 5,988,119 | A | * | 11/1999 | Trublowski et al. | 123/647 |
| H1841 | H | | 3/2000 | Simmons | |
| 6,047,799 | A | * | 4/2000 | Ahnert et al. | 192/3.56 |
| 6,226,179 | B1 | * | 5/2001 | Lee | 361/687 |

FOREIGN PATENT DOCUMENTS

| | | | | |
|---|---|---|---|---|
| IT | 0813008 | A1 | * 12/1997 | F16J/15/12 |

* cited by examiner

*Primary Examiner*—Willis R. Wolfe
(74) *Attorney, Agent, or Firm*—Brooks & Kushman, P.C.

(57) ABSTRACT

An electronic device and enclosure assembly is provided for use with an engine arrangement having a plurality of cavities. The assembly comprises an enclosure including a main body having a base panel. The base panel includes a plurality of openings alignable with the cavities. An electronic device is disposable in the enclosure and has a plurality of apertures alignable with the openings and the cavities. The assembly further includes a plurality of fasteners for connecting the electronic device to the enclosure, and for connecting the enclosure to the engine arrangement. Each fastener is configured to extend through an aperture in the electronic device, through an opening in the enclosure, and into a cavity of the engine arrangement.

38 Claims, 3 Drawing Sheets

ENGINE CONTROLLER AND ENCLOSURE ASSEMBLY

TECHNICAL FIELD

The invention relates to an electronic device and enclosure assembly especially useful in hazardous or potentially hazardous environments.

BACKGROUND ART

Engines may be controlled by an electronic control unit or controller having volatile and non-volatile memory, input and output driver circuitry, and a processor capable of executing a stored instruction set. These components are typically housed in a plastic or metal housing, such as an aluminum housing, that is attached to an engine with bolts. Such an arrangement, however, may not be suitable for use in hazardous or potentially hazardous environments.

There are various commercially available enclosures typically used for housing terminal strips and certified for use in hazardous or potentially hazardous environments. A particular enclosure for housing a terminal strip includes a main body having a base plate and a plurality of projections extending from the base plate. The enclosure further includes a mounting plate on which the terminal strip may be mounted, and the mounting plate is attached to the base plate with bolts that extend through the projections. Furthermore, the enclosure includes one or more mounting brackets attached to an exterior surface of the main body. Additional bolts are typically inserted through the brackets to secure the enclosure to a static surface.

Because of the numerous components, such an enclosure is expensive to manufacture and difficult to use. Furthermore, the enclosure is designed for use in static environments, and is not suitable for use on an engine, which typically experiences vibrations or other motion during use.

DISCLOSURE OF INVENTION

The invention addresses the shortcomings of the prior art by providing an electronic device and enclosure assembly that is adapted to be mounted on an engine. Furthermore, the assembly is particularly useful in hazardous or potentially hazardous environments.

Under the invention, an electronic device e and enclosure assembly is provided for use with an engine arrangement having a plurality of holes. The assembly comprises an enclosure including a main body having a base panel. The base panel includes a plurality of openings alignable with the holes. An electronic device is disposable in the enclosure and has a plurality of apertures alignable with the openings and the holes. The assembly further includes a plurality of fasteners for connecting the electronic device to the enclosure, and for connecting the enclosure to the engine arrangement. Each fastener is configured to extend through an aperture in the electronic device, through an opening in the enclosure, and into a hole of the engine arrangement.

Thus, the same fasteners are used to connect the electronic device to the enclosure, and to connect the enclosure to the engine arrangement. With such an arrangement, the number of parts can be minimized.

The electronic device of the assembly is preferably an engine controller. Alternatively, the electronic device may be any suitable device such as a terminal strip or other engine module.

Each fastener preferably includes a fastener body having first and second elongated sections separated by an enlarged middle portion. The first section of each fastener is configured to extend through a particular opening, and the second section of each fastener is configured to extend through a particular aperture so that the middle portion of each fastener is disposable between the enclosure and the electronic device. With such a configuration, the electronic device can be removed from the enclosure without removing the enclosure from the engine arrangement.

The enclosure may further include a load distribution strip connected to the base panel and having an additional opening aligned with one opening of the base panel. Preferably, the enclosure includes two load distribution strips connected to the base panel and spaced away from each other. Furthermore, each load distribution strip preferably has two additional openings aligned with two openings of the base panel. Advantageously, the load distribution strips distribute loads applied to the fasteners.

While the enclosure may comprise any suitable material, in a preferred embodiment the enclosure comprises stainless steel. Such material inhibits corrosion and provides good structural characteristics.

A system according to the invention includes an engine arrangement having a plurality of holes. An enclosure disposed proximate the engine arrangement includes a main body having a base panel, and the base panel has a plurality of openings aligned with the holes. An electronic device is disposed in the enclosure and has a plurality of apertures aligned with the openings and the holes. The system further includes a plurality of fasteners that connect the electronic device to the enclosure, and further connect the enclosure to the engine arrangement. Each fastener extends through an aperture in the electronic device, through an opening in the enclosure, and into a hole of the engine arrangement.

These and other objects, features, and advantages of the present invention are readily apparent from the following detailed description of the best modes for carrying out the invention when taken in connection with the accompanying drawings.

BEST MODES FOR CARRYING OUT THE INVENTION

Figure 1:
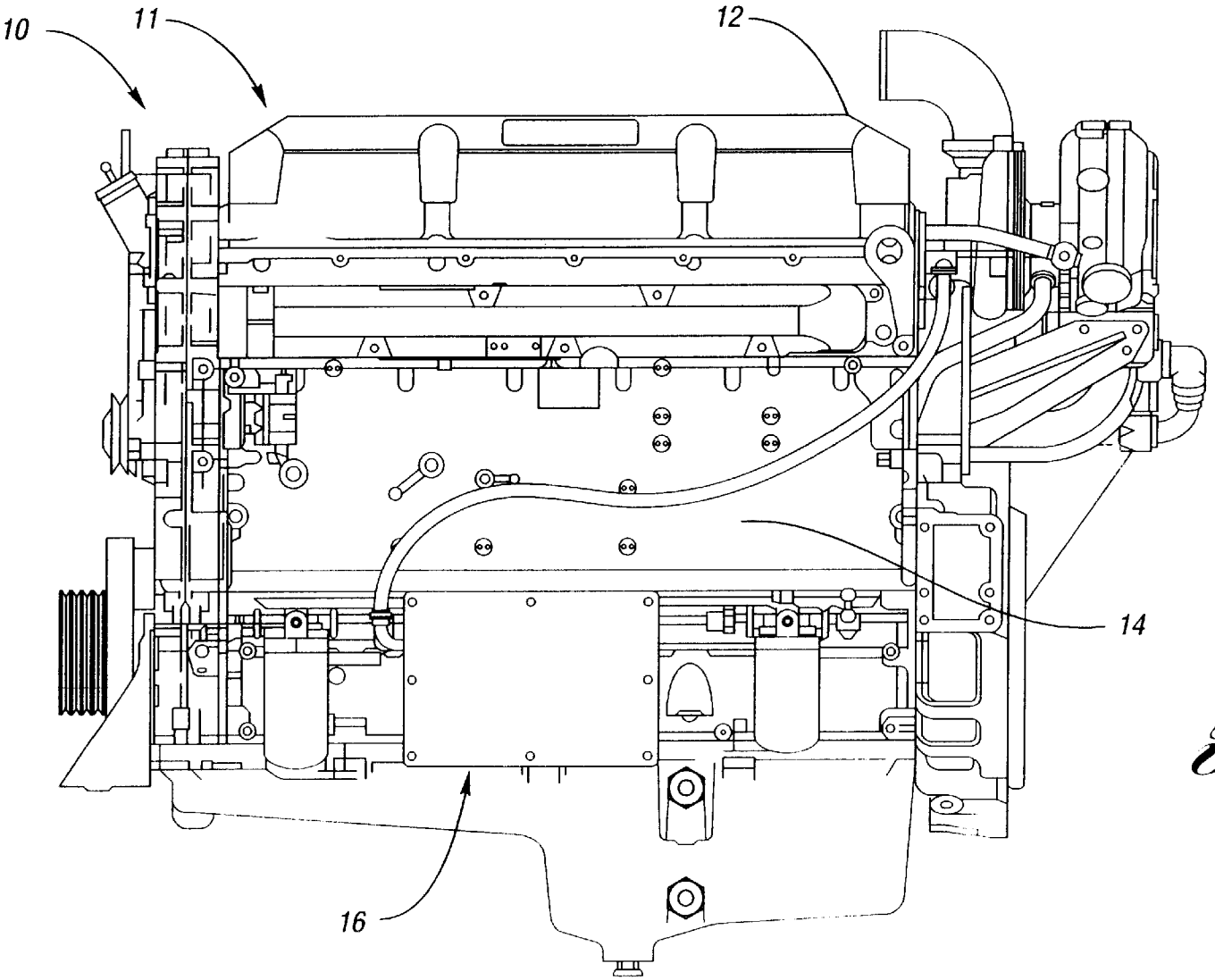
FIG. 1 is a front view of a system according to the invention including an engine controller and enclosure assembly mounted to an engine block of an engine.

FIG. 1 shows a system 10 according to the invention including an engine arrangement 11 having an engine 12, and the engine 12 includes an engine block 14. The system 10 further includes an electronic device and enclosure assembly, such as an engine controller and enclosure assembly 16, which is preferably attached directly too the block 14. While the system 10 may be used in any suitable environment, the system 10 is particularly useful in a hazardous or potentially hazardous environment, as explained below in greater detail. Hazardous or potentially hazardous environments include environments in which combustible materials are present in either a confined or unconfined state. Such environments may include, for example, underground mining operations, construction operations and offshore drilling operations. The system 10 may be used with a vehicle or any other engine-operated equipment such as mining equipment, construction equipment and/or drilling equipment. Examples of such equipment include mud pumps and fracturing units.

The engine 12 has a plurality of cylinders (not shown) disposed in the block 14, and each cylinder is fed by one or more fuel injectors (not shown). In a preferred embodiment, engine 12 is a multi-cylinder compression ignition internal combustion engine, such as a four, six, eight, twelve, sixteen or twenty-four cylinder diesel engine, for example.

Figure 2:
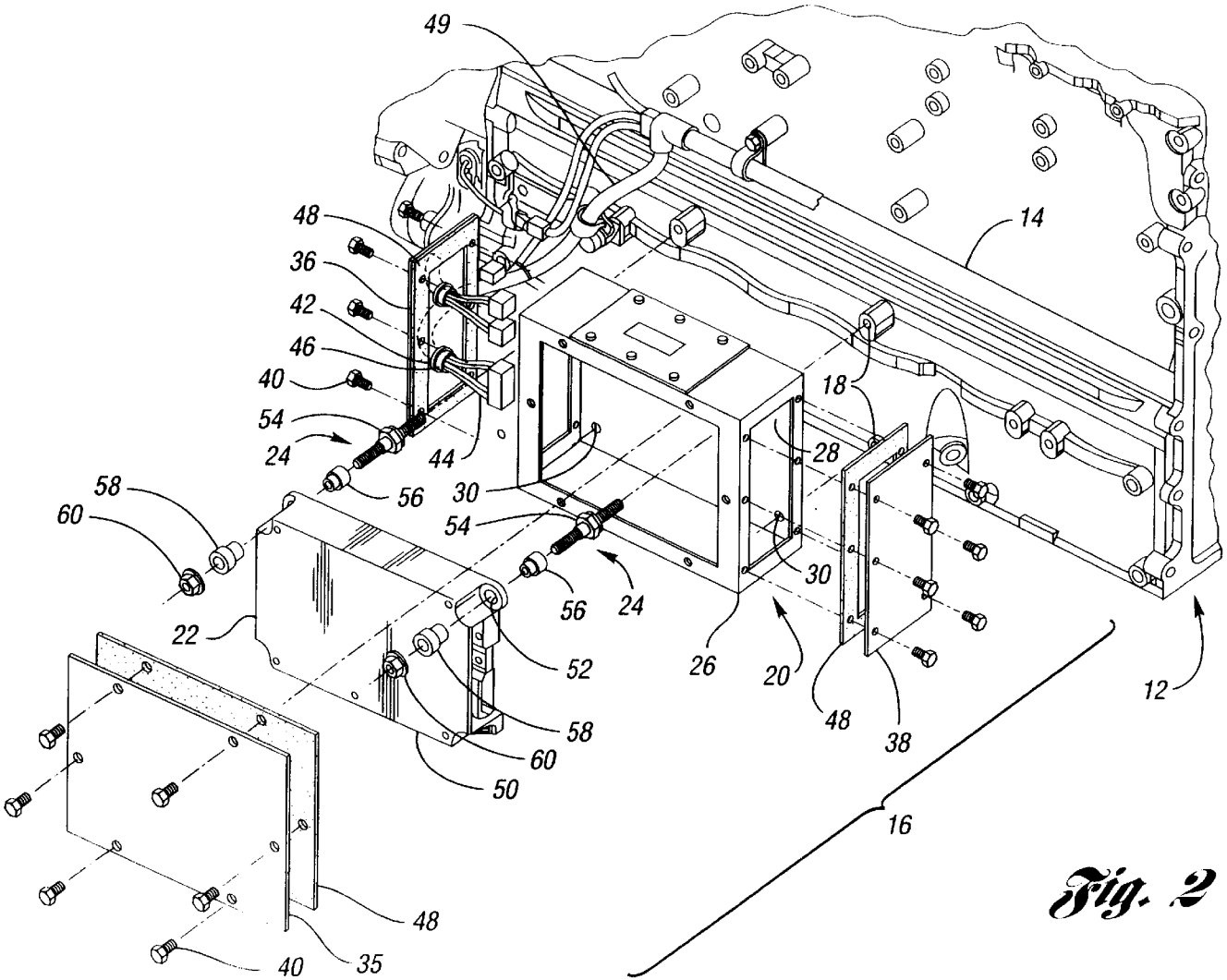
FIG. 2 is an exploded perspective view of the assembly showing an enclosure, an engine controller disposable in the enclosure, and a plurality of fasteners for connecting the enclosure to the engine block, and for connecting the engine controller to the enclosure, wherein the enclosure includes a main body and a pair of load distribution strips attached to the ma in body.

As shown in FIG. 2, the block 14 has a plurality of threaded holes such as cavities 18 formed therein. While the block 14 may comprise any suitable material and be manufactured in any suitable manner, the block 14 preferably comprises cast metal, such as cast iron or cast aluminum.

The engine controller and enclosure assembly 16 includes an enclosure 20, an engine control unit or controller 22, and a plurality of fasteners 24 for connecting the controller 22 to the enclosure 20, and for connecting the enclosure 20 to the block 14. While the particular embodiment shown in FIG. 2 includes 4 fasteners 24, only two fasteners 24 are shown.

Figure 3:
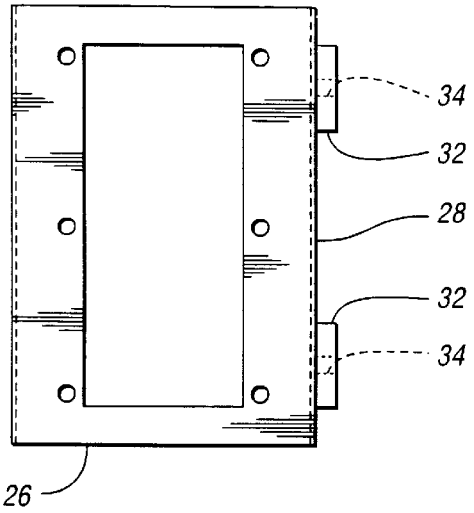
FIG. 3 is a side view of the m main body and load distribution strips of the enclosure.
Figure 4:
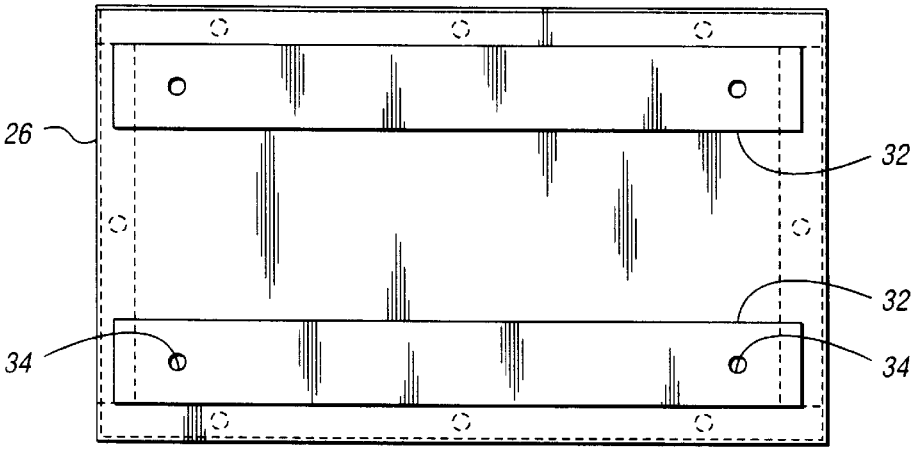
FIG. 4 is a bottom view of the main body and load distribution strips of the enclosure.

Referring to FIGS. 2 through 4, the enclosure 20 includes a main body 26 having a base panel 28. The base panel 28 has a plurality of first openings 30 that are alignable with the cavities 18 in the block 14. A plurality of load distribution strips 32 are connected to the base panel 28 in any suitable manner, such as with an adhesive or by welding the strips 32 to the base panel 28. Each strip 32 has a plurality of second openings 34 aligned with corresponding first openings 30 in the base panel 28. The strips 32 are preferably relatively rigid and function to distribute loads over the base panel 28 that are applied to and transmitted through the fasteners 24. As a result, the base panel 28 and the remainder of the main body 26 may be relatively thin. For example, the thickness of the base panel 28 and the remainder of the main body 26 is preferably in the range of 1 to 8 millimeters (mm). Each strip 32, however, preferably has a thickness greater than the thickness of the base panel 28. For example, each strip 32 may have a thickness in the range of 6 to 12 mm.

The enclosure 20 further includes a cover 35, and first and second side panels 36 and 38, respectively, that may be connected to the main body 26 in any suitable manner such as with fasteners 40. Alternatively, the side panels 36 and 38 may be formed as part of the main body 26. The first side panel 36 has a plurality of holes 42 for receiving wires 44, which are used to electrically connect the controller 22, or other suitable electronic device, to the fuel injectors of the engine 12 and/or other components of the system 10, such as various sensors and actuators. A seal such as a cable gland 46 is disposed in each hole 42 for sealing the wires 44 in the holes 42. A gasket 48 is preferably attached to the cover 35 and each side panel 36 and 38, and the gaskets 48 may comprise any suitable material such as neoprene or silicone.

If the wires 44 are required to be installed in conduit, such as conduit 49 shown in FIG. 2, the enclosure 20 may also be configured such that the conduit 49 may be attached thereto. For example, the holes 42 in the side panel 36 may be threaded so as to receive a threaded end of conduit 49, or a threaded connector connected to the conduit 49. As another example, the holes 42 may be sufficiently large such that the conduit 49 may extend through the holes 42. A threaded nut (not shown) may then be secured to an end of the conduit 49 and engaged with an interior surface of the side panel 36 so as to attach the conduit 49 to the enclosure 20. Such an arrangement may be desirable if, for example, the side panel 36 is not thick enough to allow the holes 42 to be threaded.

While the enclosure 20 may comprise any suitable material such as metal or plastic, the enclosure 20 preferably comprises stainless steel. In one embodiment of the invention, the enclosure 20 comprises 316 stainless steel. Such a steel inhibits corrosion and provides good structural characteristics. Other suitable materials include anodized aluminum and polycarbonate.

The enclosure 20 preferably meets applicable standards regarding use in hazardous or potentially hazardous environments. For example, with respect to North America, the enclosure 20 is preferably a Type 1 enclosure and meets Underwriters Laboratories standard UL50 entitled"Enclosures for Electrical Equipment." With respect to Europe, the enclosure 20 preferably complies with standard EN 50021, which is the applicable standard for a Group II, Zone 2 certification for an electrical apparatus for potentially explosive atmospheres. Furthermore, the enclosure 20 preferably has a minimum dust/water ingression protection (IP) rating of IP54, as defined in standard EN-60529, such that the enclosure 20 sufficiently inhibits or prevents infiltration of moisture and/or dust.

The controller 22 includes a housing 50 having a plurality of apertures 52 alignable with the openings 30 and 34 and the cavities 18. Inside the housing 50, the controller 22 may include volatile and non-volatile memory, input and output driver circuitry, and a processor capable of executing a stored instruction set for controlling operation of the engine 12. In a preferred embodiment, the controller 22 is a DDEC controller available from Detroit Diesel Corporation, Detroit, Mich. Various other features of this controller 22 are described in detail in co-pending application Ser. No. 09/730,064, entitled METHOD AND SYSTEM FOR ENHANCED ENGINE CONTROL, still pending and co-pending application Ser. No. 09/730,943, entitled METHOD AND SYSTEM FOR ENHANCED ENGINE CONTROL BASED ON CYLINDER PRESSURE, still pending. The disclosures of these co-pending applications are hereby incorporated by reference in their entirety.

Figure 5:
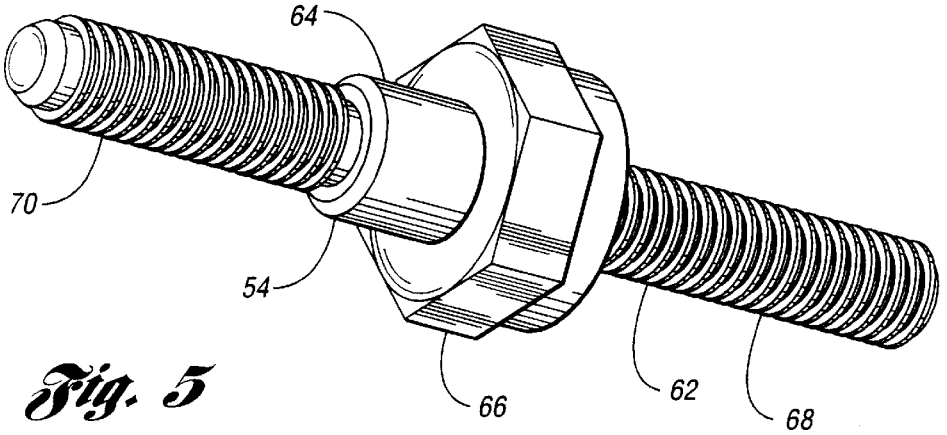
FIG. 5 is a perspective view of a fastener body of a particular fastener.

Referring to FIGS. 2 and 5, each fastener 24 includes a fastener body or stud 54, first and second isolators 56 and 58, respectively, and a nut 60. Each stud 54 includes first and second elongated sections 62 and 64, respectively, separated by an enlarged middle portion 66. The first and second elongated sections 62 and 64, respectively, have first and second threaded portions 68 and 70, respectively. The first section 62 of each stud 54 is configured to extend through aligned first and second openings 30 and 34, and into a particular cavity 18 in the block 14 so that the first threaded portion 68 may threadingly engage the particular cavity 18. The middle portions 66 of the studs 54 function as nuts for securing the enclosure 20 to the block 14, and also function as spacers for spacing the controller 22 away from the base panel 28. The second section 64 of each stud 54 is configured to extend through a particular first isolator 56, a particular aperture 52, and a particular isolator 58. The nuts 60, which are threadingly engageable with the second threaded portions 70 of the studs 54, are then used to secure the controller 22 to the enclosure 20.

Alternatively, the second section 64 and middle portion 66 of each stud 54 may comprise an electrically isolating material, such as plastic, so that the isolators 56 and 58 can be eliminated. For example, the second section 64 and middle portion 66 of each stud 54 may be coated with plastic.

Because the fasteners 24 are used to connect the controller 22 to the enclosure 20, and also to connect the enclosure 20 to the block 14, the number of components of the assembly 16 can be minimized. Furthermore, the number of first openings 30 in the enclosure 20 can also be minimized. In addition, because the studs 54 have enlarged middle portions 66, the controller 22 can be removed from the enclosure 20 without removing the main body 26 of the enclosure 20 from the block 14. Therefore, the controller 22 can be easily serviced and/or replaced.

Alternatively, the fasteners 24 may be used to connect any suitable electronic device to the enclosure 20, such as a terminal strip or other engine module having suitable apertures extending there through. Examples of other engine modules include a maintenance alert system module, an exhaust gas re-circulation control module, an ether start module and a signal to noise enhancement filter module. Furthermore, the fasteners 24 may be used to connect the enclosure 20 and controller 22, or other electronic device, to another portion of the engine arrangement 11, other than the engine block 14. For example, the enclosure 20 and controller 22, or other electronic device, may be connected to a frame (not shown) of the engine arrangement 11, such as a vehicle frame or an engine support frame having threaded holes formed therein. As another example, the enclosure 20 and controller 22, or other electronic device, may be connected to an equipment skid (not shown) that supports the engine 12 as well as other equipment. Generally, then, the fasteners 24 may be used to connect an electronic device and enclosure assembly to any suitable portion of the engine arrangement 11.

Because the enclosure 20 preferably meets applicable standards regarding use in hazardous or potentially hazardous environments, the controller 22, or other electronic device, may not have to be sealed or independently tested or certified for use in such environments.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system comprising:

an engine including a block having a plurality of threaded cavities;

an enclosure disposed proximate the block and including a main body having a base panel, and a load distribution strip connected to the base panel, the base panel having a plurality of first openings aligned with the cavities, and the load distribution strip having a plurality of second openings aligned with the first openings and the cavities;

an engine controller disposed in the enclosure and having a plurality of apertures aligned with the openings and the cavities, the engine controller being in communication with the engine for controlling operation of the engine; and a plurality of fasteners connecting the engine controller to the enclosure, and further connecting the enclosure to the block, each fastener including a fastener body having first and second elongated sections separated by an enlarged middle portion, each section having a threaded portion, the first section of each fastener extending through aligned first and second openings and into a corresponding cavity, the second section of each fastener extending through a corresponding aperture so that the middle portion of each fastener is disposed between the enclosure and the engine controller, each fastener further including a nut engaged with the threaded portion of the second section;

wherein the load distribution strip distributes loads over the base panel that are applied to the fasteners.

2. An electronic device and enclosure assembly for use with an engine arrangement having a plurality of holes, the electronic device and enclosure assembly comprising:

an enclosure having a base panel and at least one load distribution strip connected to the base panel, the base panel including a plurality of openings alignable with the holes, each load distribution strip having at least one additional opening, each additional opening being aligned with one of the openings of the base panel;

an electronic device disposable in the enclosure; and a plurality of fasteners for connecting the enclosure to the engine arrangement, each fastener being configured to extend through one of the openings of the base panel and into one of the holes of the engine arrangement, one of the fasteners being configured to also extend through one additional opening of one of the at least one load distribution strip.

3. The assembly of claim 2 wherein the base panel has a first thickness, and each load distribution strip has a second thickness greater than the first thickness.

4. The assembly of claim 2 wherein the at least one load distribution strip includes two load distribution strips.

5. The assembly of claim 4 wherein each load distribution strip includes two additional openings, and each fastener is configured to extend through one of the openings of the base panel, through one of the additional openings of one of the load distribution strips and into one of the holes of the engine arrangement.

6. An electronic device and enclosure assembly for use with an engine arrangement having a plurality of holes, the electronic device and enclosure assembly comprising:

an enclosure including a main body having a base panel, the base panel including a plurality of openings alignable with the holes;

an electronic device disposable in the enclosure and having a plurality of apertures alignable with the openings and the holes; and a plurality of fasteners for connecting the electronic device to the enclosure, and for connecting the enclosure to the engine arrangement, each fastener being configured to extend through an aperture in the electronic device, through an opening in the enclosure, and into a hole of the engine arrangement.

7. The assembly of claim 6 wherein the electronic device is an engine controller.

8. The assembly of claim 6 wherein the electronic device is a terminal strip.

9. The assembly of claim 6 wherein the enclosure comprises stainless steel.

10. The assembly of claim 6 wherein the enclosure comprises aluminum.

11. The assembly of claim 6 wherein the enclosure comprises polycarbonate.

12. The assembly of claim 6 wherein the enclosure further includes two load distribution strips connected to the base panel and spaced away from each other, each load distribution strip having two additional openings aligned with two openings of the base panel, each load distribution strip further having a thickness greater than a thickness of the base panel.

13. The assembly of claim 6 wherein the fasteners are configured to allow removal of the electronic device from the enclosure without requiring removal of the main body of the enclosure from the engine arrangement.

14. The assembly of claim 6 wherein each fastener includes a unitary stud having first and second elongated sections separated by an enlarged portion, each section having a threaded portion, the first section of each stud being configured to extend through a particular opening, the second section of each stud being configured to extend through a particular aperture so that the enlarged portion of each stud is disposable between the enclosure and the electronic device.

15. The assembly of claim 14 wherein each fastener includes a nut that is engageable with the second section of the respective stud.

16. The assembly of claim 6 wherein each fastener includes a fastener body having first and second elongated sections separated by an enlarged portion, each section having a threaded portion, the first section of each fastener body being configured to extend through a particular opening, the second section of each fastener body being configured to extend through a particular aperture so that the enlarged portion of each fastener body is disposable between the enclosure and the electronic device.

17. The assembly of claim 16 wherein the second section and enlarged portion of each fastener body comprise an electrically insulating material.

18. The assembly of claim 16 wherein each fastener includes a nut that is engageable with the second section of the respective fastener body, and wherein the electronic device is configured to extend between the nut and the middle portion of each fastener when the electronic device is connected to the enclosure and the nuts are engaged with the fastener bodies.

19. The assembly of claim 6 wherein the enclosure further includes a load distribution strip connected to the base panel, the load distribution strip having an additional opening aligned with one opening of the base panel.

20. The assembly of claim 19 wherein the base panel has a first thickness, and the toad distribution strip has a second thickness greater than the first thickness.

21. The assembly of claim 19 wherein the base panel has a first thickness, and the load distribution strip has a second thickness greater than the first thickness.

22. A system comprising:

an engine arrangement including a plurality of holes;

an enclosure disposed proximate the engine arrangement and including a main body having a base panel, the base panel having a plurality of openings aligned with the holes;

an electronic device disposed in the enclosure and having a plurality of apertures aligned with the openings and the holes; and a plurality of fasteners connecting the electronic device to the enclosure, and further connecting the enclosure to the engine arrangement, each fastener extending through an aperture in the electronic device, through an opening in the enclosure, and into a hole of the engine arrangement.

23. The system of claim 22 wherein the electronic device is an engine controller.

24. The system of claim 22 wherein the electronic device is a terminal strip.

25. The system of claim 22 wherein the enclosure comprises stainless steel.

26. The system of claim 22 wherein the enclosure comprises aluminum.

27. The system of claim 22 wherein the enclosure comprises polycarbonate.

28. The system of claim 22 wherein the enclosure further includes a load distribution strip connected to the base panel, the load distribution strip having an additional opening aligned with one opening of the base panel.

29. The system of claim 22 wherein the enclosure further includes two load distribution strips connected to the base panel and spaced away from each other, each load distribution strip having two additional openings aligned with two openings of the base panel, each load distribution strip further having a thickness greater than a thickness of the base panel.

30. The system of claim 22 wherein the enclosure further includes a side panel connected to the main body, the side panel having a panel hole and a seal disposed in the panel hole, and the system further includes at least one wire extending through the panel hole and the seal, the at least one wire being connected to the electronic device.

31. The system of claim 22 further comprising at least one wire extending through the enclosure and connected to the electronic device, and a conduit surrounding the wire and connected to the enclosure.

32. The system of claim 22 wherein the fasteners are configured to allow removal of the electronic device from the enclosure without requiring removal of the main body of the enclosure from the engine arrangement.

33. The system of claim 22 wherein each fastener includes a unitary stud having first and second elongated sections separated by an enlarged portion, each section having a threaded portion, the first section of each stud extending through a particular opening, the second section of each stud extending through a particular aperture so that the enlarged portion of each stud is disposed between the enclosure and the electronic device.

34. The system of claim 33 wherein each fastener includes a nut engaged with the second section of the respective stud.

35. The system of claim 22 wherein each fastener includes a fastener body having first and second elongated sections separated by an enlarged middle portion, the first section of each fastener body extending through a particular opening, the second section of each fastener body extending through a particular aperture so that the middle portion of each fastener body is disposed between the enclosure and the electronic device.

36. The system of claim 35 wherein the second section and middle portion of each fastener body comprise an electrically insulating material.

37. The system of claim 35 wherein each fastener further includes two isolators disposed about the second section such that the electronic device is disposed between the isolators of each fastener, and a nut engaged with the second section such that the electronic device extends between the middle portion and the nut of each fastener.

38. The system of claim 35 wherein each fastener includes a nut engaged with the second section of the respective fastener body, and wherein the electronic device extends between the nut and the middle portion of each fastener.

* * * * *

UNITED STATES PATENT AND TRADEMARK OFFICE

CERTIFICATE OF CORRECTION

PATENT NO. : 6,487,995 B2 
DATED : December 3, 2002
INVENTOR(S) : Craig R. Mrkyvech et al.

It is certified that error appears in the above-identified patent and that said Letters Patent is hereby corrected as shown below:

Column 7,
Line 48, delete "toad" and insert -- load -- therefor.

Signed and Sealed this

Twentieth Day of May, 2003

JAMES E. ROGAN
*Director of the United States Patent and Trademark Office*